US009533521B2

(12) United States Patent
Furuya

(10) Patent No.: US 9,533,521 B2
(45) Date of Patent: Jan. 3, 2017

(54) IMAGE FORMING APPARATUS, IMAGE FORMING METHOD AND NON-TRANSITORY COMPUTER READABLE MEDIUM

(71) Applicant: FUJI XEROX CO., LTD., Tokyo (JP)

(72) Inventor: Masami Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/726,664

(22) Filed: Jun. 1, 2015

(65) Prior Publication Data

US 2016/0167413 A1 Jun. 16, 2016

(30) Foreign Application Priority Data

Dec. 16, 2014 (JP) ..... 2014-254346

(51) Int. Cl.
*B41J 29/393* (2006.01)
*B41J 29/38* (2006.01)

(52) U.S. Cl.
CPC ..... *B41J 29/38* (2013.01)

(58) Field of Classification Search
CPC ..... B41J 29/39; B41J 2029/3935; B41J 2/165; B41J 2/16579; B41J 2/2139; B41J 2/2142
See application file for complete search history.

(56) References Cited

U.S. PATENT DOCUMENTS

2012/0162721 A1* 6/2012 Shimizu ..... B41J 2/16579 358/448

FOREIGN PATENT DOCUMENTS

| | | |
|---|---|---|
| JP | 2006-240148 | 9/2006 |
| JP | 2006-240232 | 9/2006 |
| JP | 2012-139901 | 7/2012 |

OTHER PUBLICATIONS

Abstract and machine translation of JP2006-240148.
Abstract and machine translation of JP2006-240232.
Abstract and machine translation of JP 2012-139901.

* cited by examiner

*Primary Examiner* — Jason Uhlenhake
(74) *Attorney, Agent, or Firm* — Fildes & Outland, P.C.

(57) ABSTRACT

An image forming apparatus includes: plural recording elements that are arrayed along a crossing direction; a reading unit that sequentially reads an image formed on a recording medium; a forming unit that drives the recording elements that are continuously arrayed along the crossing direction so as to form at least one reference image on the recording medium, and then makes timings for driving the recording elements continuously arrayed in the crossing direction different from each other so as to form detection images on the recording medium; and a detection unit that detects the recording element in an abnormal state by changing a size of at least one of a threshold value and a detected value based on the detection image read by the reading unit when the recording element in the abnormal state is detected using the detected value and the threshold value.

9 Claims, 8 Drawing Sheets

(FIG. 5 CONTINUED)
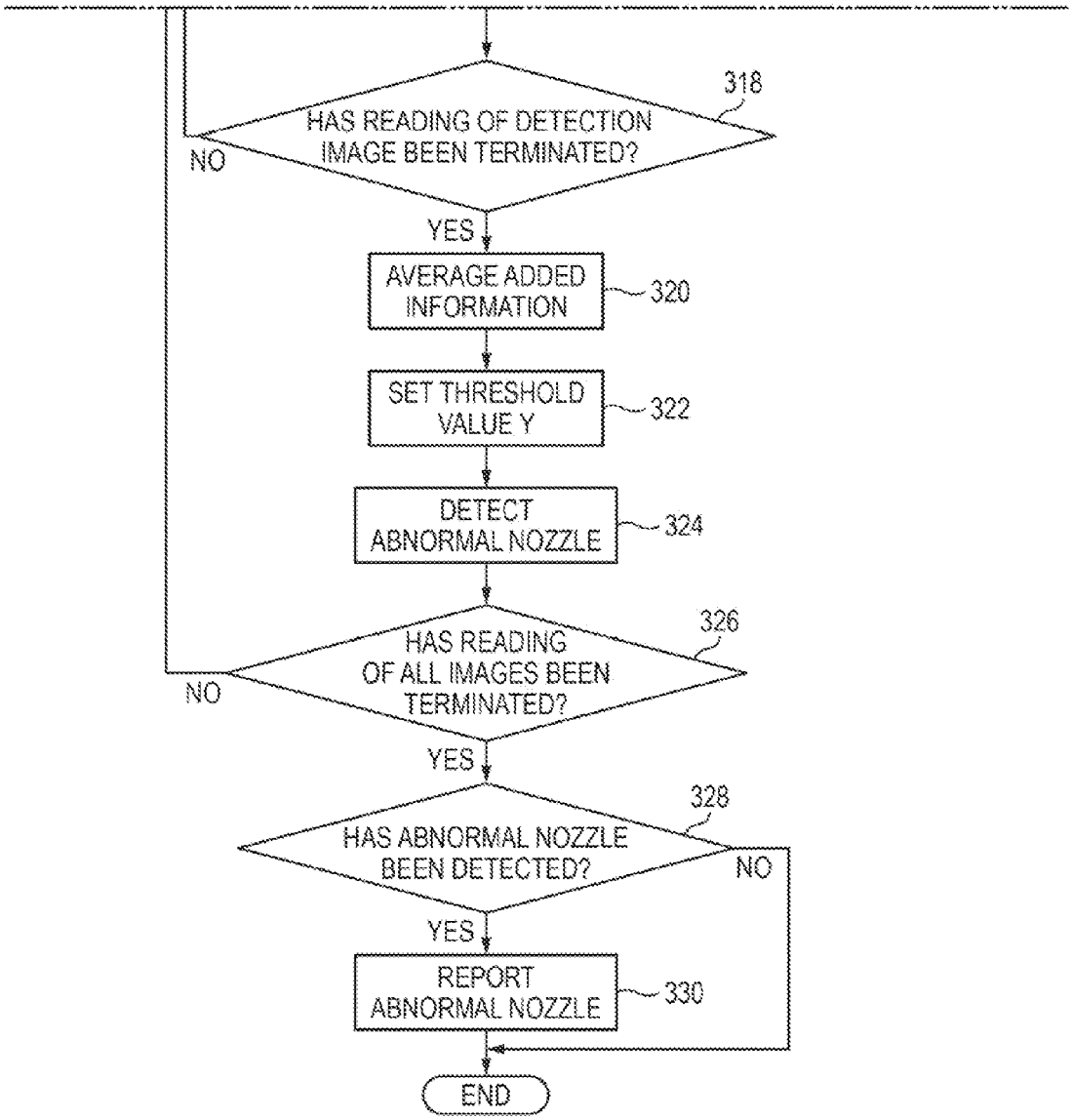

IMAGE FORMING APPARATUS, IMAGE FORMING METHOD AND NON-TRANSITORY COMPUTER READABLE MEDIUM

CROSS-REFERENCE TO RELATED APPLICATIONS

This application is based on and claims priority under 35 USC 119 from Japanese Patent Application No. 2014-254346 filed on Dec. 16, 2014.

BACKGROUND

Technical Field

The present invention relates to an image forming apparatus, an image forming method, and a non-transitory computer readable medium.

SUMMARY

An aspect of the present invention provides an image forming apparatus comprising: plural recording elements that are arrayed along a crossing direction crossing a conveyance direction of a recording medium; a reading unit that sequentially reads an image formed on the recording medium for each line extending in the crossing direction along the conveyance direction by driving the recording elements while conveying the recording medium; a forming unit that drives the recording elements that are continuously arrayed along the crossing direction while conveying the recording medium, so as to form at least one reference image, having a length in the conveyance direction being set to a length in accordance with plural times of the readings by the reading unit, on the recording medium, and then makes timings for driving the recording elements continuously arrayed in the crossing direction different from each other with respect to the plural recording elements to be subjected to detection of an abnormal state thereof, so as to form detection images on the recording medium; and a detection unit that detects the recording element in the abnormal state by changing a size of at least one of a threshold value and a detected value based on the detection image read by the reading unit so that a rate at which it is determined to be the abnormal state is lowered as a difference between a timing when one end of the at least one reference image in the crossing direction is read by the reading unit and a timing when the other end thereof is read increases, when the recording element in the abnormal state is detected using the detected value and the threshold value.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiment(s) of the invention will be described in detail with reference to the accompanying drawings. Here, a description will be given of a case where the invention is applied to an ink jet recording apparatus that records an image by ejecting ink drops onto a recording medium.

First, the configuration of an ink jet recording apparatus 10 according to the present embodiment will be described with reference to FIGS. 1 and 2.

Figure 1:
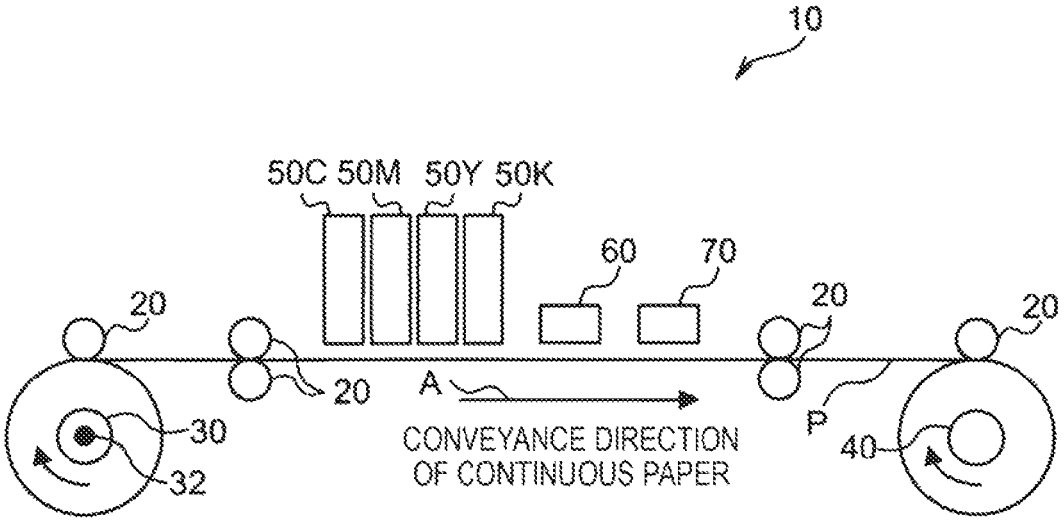
FIG. 1 is a schematic side view illustrating main constituent portions of an ink jet recording apparatus according to an embodiment.

As illustrated in FIG. 1, the ink jet recording apparatus 10 according to the present embodiment includes a conveyance roller 20, a paper feeding roll 30, a rotary encoder 32, a discharge roll 40, recording heads 50C, 50M, 50Y, and 50K, a drying unit 60, and an image reading unit 70.

The conveyance roller 20 according to the present embodiment is rotated by driving a conveyance motor 22 (see FIG. 3) which is connected to the conveyance roller 20 through a mechanism such as, for example, a gear. In addition, long continuous paper P is wound around the paper feeding roll 30 according to the present embodiment as a recording medium, and is conveyed in the direction of an arrow A of FIG. 1 in association with the rotation of the conveyance roller 20. In addition, the conveyed continuous paper P is wound around the discharge roll 40. Meanwhile, hereinafter, a direction in which the continuous paper P is conveyed (direction of the arrow A of FIG. 1) is simply referred to as a "conveyance direction".

The rotary encoder 32 according to the present embodiment is provided in a rotation axis of the paper feeding roll 30, and outputs a clock signal whenever the paper feeding roll 30 is rotated at a predetermined angle.

The recording heads 50C, 50M, 50Y, and 50K according to the present embodiment are provided along a conveyance direction in this order from an upstream in the conveyance direction. Meanwhile, hereinafter, when the recording heads 50C, 50M, 50Y, and 50K do not need to be distinguished from each other, the alphabet at the tail of the reference numeral will be omitted.

Figure 2:
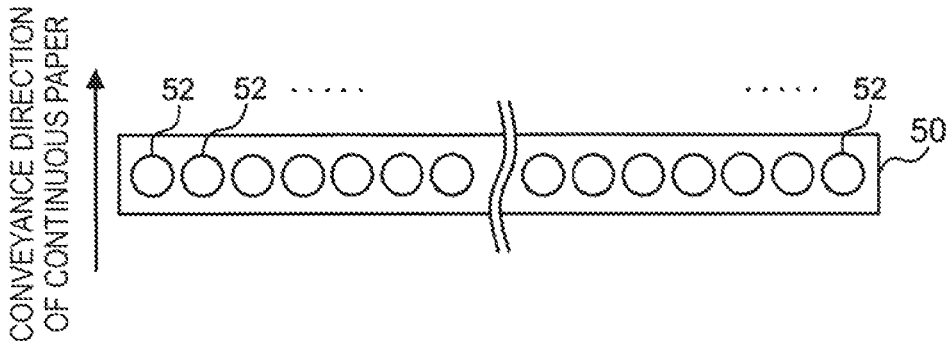
FIG. 2 is a schematic bottom view illustrating a schematic configuration of a recording head according to the embodiment.

In addition, as illustrated in FIG. 2, the recording head 50 includes plural nozzles 52 which are arrayed along a crossing direction crossing the conveyance direction (hereinafter, simply referred to as a "crossing direction"). Meanwhile, the nozzle 52 is an example of a recording element of the invention. The recording heads 50C, 50M, 50Y, and 50K eject ink drops corresponding to the respective four colors of cyan (C), magenta (M), yellow (Y), and black (K) onto the continuous paper P from the nozzles 52. Meanwhile, in the ink jet recording apparatus 10 according to the present embodiment, nozzle numbers of 1, 2, . . . are given to the respective nozzles 52 in order from 1 in order to identify the respective nozzles 52.

The drying unit 60 according to the present embodiment includes, for example, plural surface-emitting laser elements, and ink drops are dried by performing irradiation with a laser from the surface-emitting laser elements on the ink drops ejected onto the continuous paper P to thereby fix the ink drops to the continuous paper P. Meanwhile, another apparatus such as a heater which dries the ink drops ejected onto the continuous paper P by warm air may be used as the drying unit 60.

The image reading unit 70 according to the present embodiment is constituted by a line sensor including a photoelectric conversion element such as for example, a charge coupled device (CCD), and reads an image formed on the continuous paper P with a predetermined resolution for each line extending in the crossing direction along the conveyance direction. The image reading unit 70 outputs luminance information indicating a luminance value of each pixel according to the concentration of the read image.

Figure 3:
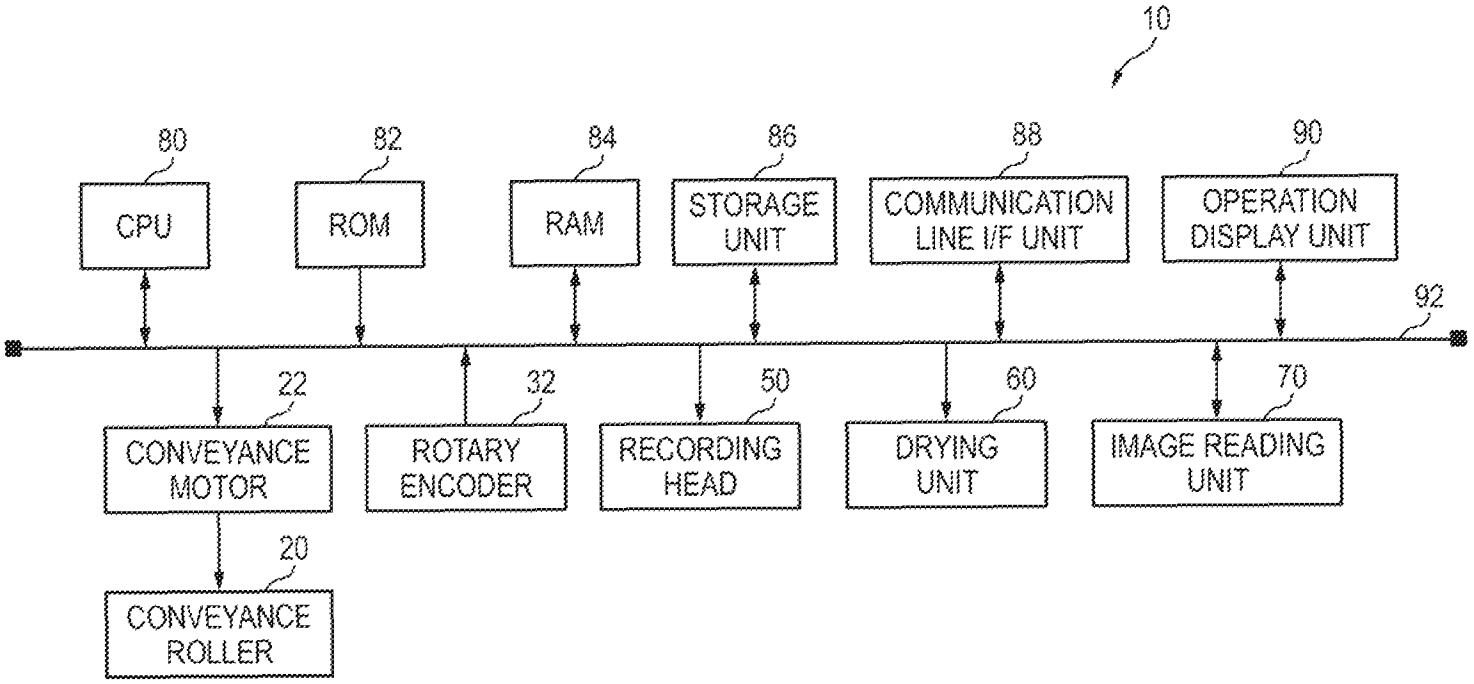
FIG. 3 is a block diagram illustrating main components of an electric system of the ink jet recording apparatus according to the embodiment.

Next, main components of an electric system of the ink jet recording apparatus 10 according to the present embodiment will be described with reference to FIG. 3.

Figure 8:
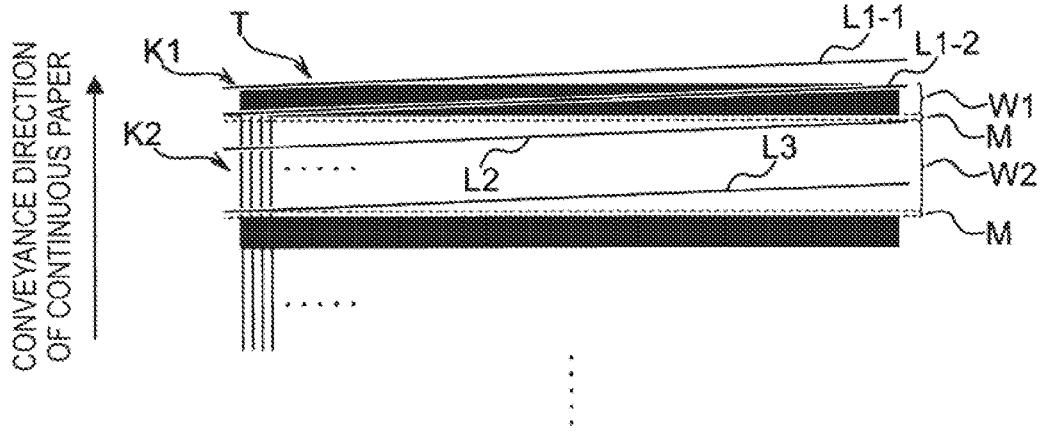
FIG. 8 is a plan view illustrating an example of a reading process performed by the image reading unit in a state where the continuous paper and the image reading unit according to the embodiment are inclined.

As illustrated in FIG. 8, the ink jet recording apparatus 10 according to the present embodiment includes a central processing unit (CPU) 80 that controls the entire operation of the ink jet recording apparatus 10, and a read only memory (ROM) 82 that stores various types of programs and various types of parameters in advance. In addition, the ink jet recording apparatus 10 also includes a random access memory (RAM) 84 which is used as a work area or the like when various types of programs are executed by the CPU 80, and a nonvolatile storage unit 86 such as a flash memory.

In addition, the ink jet recording apparatus 10 includes a communication line interface (I/F) unit 88 that transmits and receives communication data to and from an external device. In addition, the ink jet recording apparatus 10 includes an operation display unit 90 that receives a user's instruction with respect to the ink jet recording apparatus 10 and notifies a user of various pieces of information regarding an operation situation of the ink jet recording apparatus 10, and the like. Meanwhile, the operation display unit 90 includes, for example, a display button that realizes the reception of an operation instruction by the execution of a program, a touch panel type display on which various pieces of information are displayed, and hardware keys such as a numeric keypad and a start button.

The units of the CPU 80, the ROM 82, the RAM 84, the storage unit 86, the conveyance motor 22, the rotary encoder 32, and the recording head 50 are connected to each other through a bus 92 such as an address bus, a data bus, and a control bus. In addition to these units, the drying unit 60, the image reading unit 70, the communication line I/F unit 88, and the operation display unit 90 are connected to each other through the bus 92. In addition, the conveyance roller 20 is connected to the conveyance motor 22.

By the above configuration, the ink jet recording apparatus 10 according to the present embodiment has access to the ROM 82, the RAM 84, and the storage unit 86 and transmits and receives communication data through the communication line I/F unit 88 by the CPU 80. In addition, the ink jet recording apparatus 10 acquires various pieces of data through the operation display unit 90 and displays various pieces of information on the operation display unit 90 by the CPU 80. In addition, the ink jet recording apparatus 10 receives a clock signal output from the rotary encoder 32 and controls the recording head 50, the drying unit 60, and the image reading unit 70 based on the clock signal by the CPU 80. In addition, the ink jet recording apparatus 10 controls the rotation of the conveyance roller 20 through the conveyance motor 22 and acquires luminance information output from the image reading unit 70 by the CPU 80.

Incidentally, the ink jet recording apparatus 10 according to the present embodiment is equipped with an abnormal nozzle detection function of detecting the nozzle 52 in an abnormal state (hereinafter, simply referred to as an "abnormal nozzle"). The ink jet recording apparatus 10 forms a test image for detecting an abnormal nozzle on the continuous paper P in order to realize, the abnormal nozzle detection function. Meanwhile, the "abnormal state of the nozzle 52" mentioned here includes, for example, non-ejection abnormality in which ink drops are not ejected, thin line abnormality in which the amount of ink drops ejected is reduced, positional deviation abnormality in which landing positions of ink drops are shifted, and the like. Hereinafter, only a case where an abnormal nozzle of the recording head 50K is detected will be described in order to avoid complication, but the same is true of the recording heads 50C, 50M, and 50Y corresponding to other colors.

Next, a test image in the ink jet recording apparatus 10 according to the present embodiment will be described with reference to FIG. 4. Meanwhile, hereinafter, a description will be given of a case where all of the nozzles 52 located at positions corresponding to an image forming region of the continuous paper P are set as targets to be subjected to the detection of an abnormal state. In addition, hereinafter, the nozzle 52 to be detected is referred to as a "nozzle to be detected".

Figure 4:
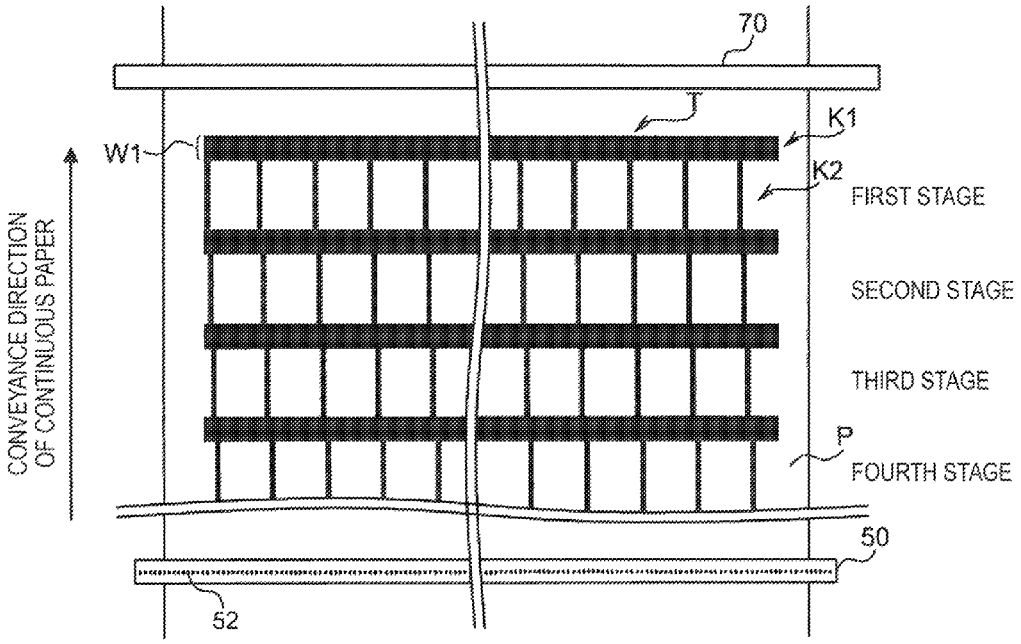
FIG. 4 is a plan view illustrating examples of a reference image and a detection image according to the embodiment.

As illustrated in FIG. 4, a test image T according to the present embodiment is an image in which plural reference images K1 and detection images K2 having the same number as the number of reference images K1 are formed alternately in the conveyance direction. The reference image K1 according to the present embodiment is an image formed by ejecting ink drops from all of the nozzles to be detected. In addition, a length W1 of the reference image K1 in the conveyance direction is set to a length in accordance with plural times of the readings by the image reading unit 70.

The detection image K2 is an image formed by dividing the nozzles to be detected into plural groups of the nozzles 52 in each of which the plural nozzles 52 arrayed in the crossing direction at intervals corresponding to a predetermined number of nozzles 52 (for example, ten nozzles in the present embodiment) and ejecting ink drops for each of the groups of the nozzles 52. The detection image K2 is formed at a timing different for each of the groups of the nozzles 52 and at a location shifted by a predetermined number of nozzles 52 (for example, one nozzle in the present embodiment) in the crossing direction.

Accordingly, the detection image K2 located at the first stage illustrated in FIG. 4 is an image formed by the 10n+1-th nozzle 52 (n=0, 1, 2 . . . ) based on the nozzle 52 located at a position corresponding to the left end of the image forming region in FIG. 4. Similarly, the detection image K2 located at the second stage illustrated in FIG. 4 is an image formed by the 10n+2-th nozzle 52 (n=0, 1, 2 . . . ) based on the nozzle 52 located at a position corresponding to the left end. That is, eleven reference images K1 and eleven detection images K2 are formed alternately. In addition, the length of the detection image K2 in the conveyance direction is also set to a length in accordance with plural times of the readings by the image reading unit 70. Meanwhile, in the present embodiment, image information indicating the test image T mentioned above (hereinafter, referred to as "test image information") is stored in the storage unit 86 in advance.

Figure 5:
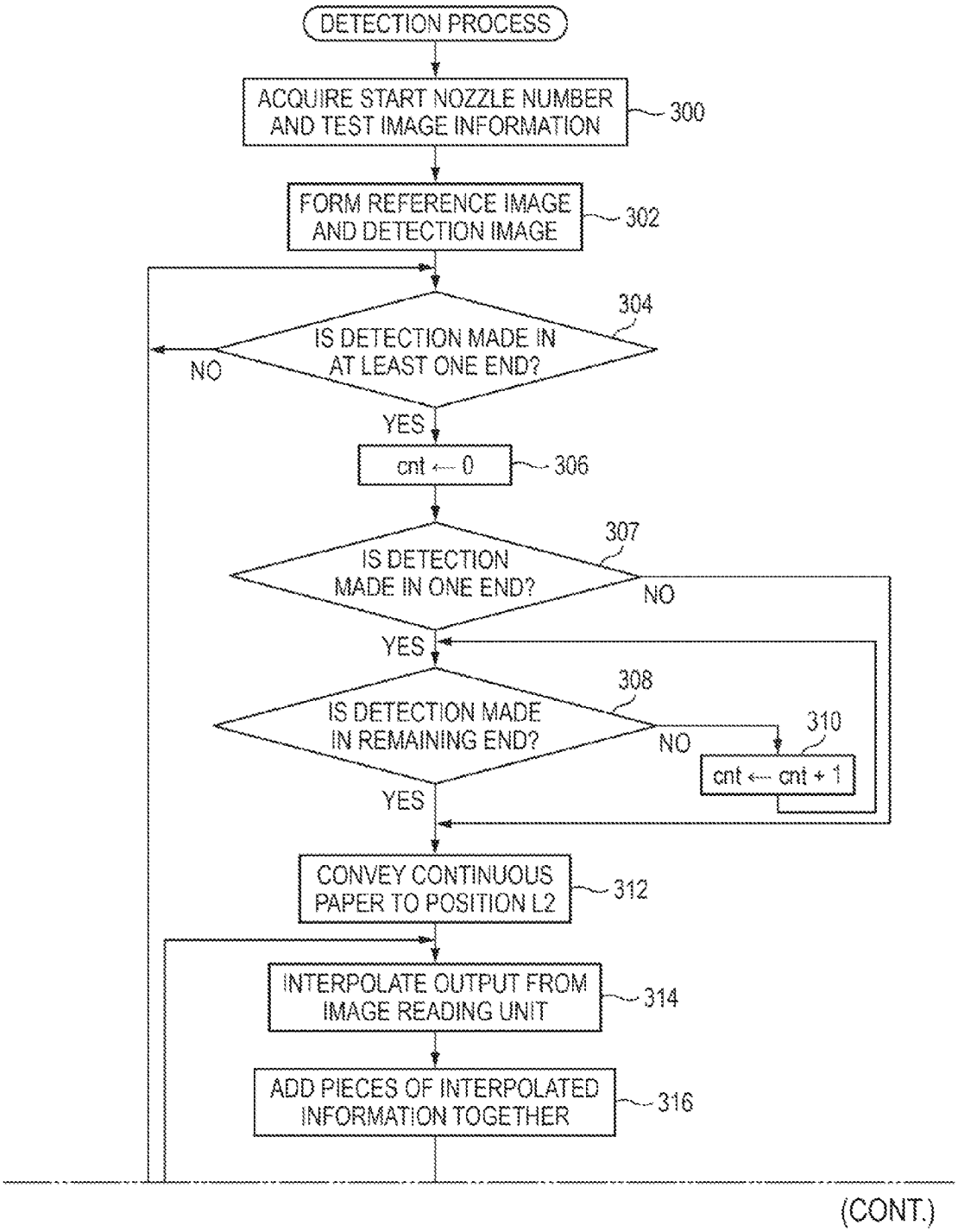
FIG. 5 is a flow chart illustrating a flow of the processing of a detection processing program according to the embodiment.

Next, the action of the ink jet recording apparatus 10 according to the present embodiment will be described with reference to FIG. 5. Meanwhile, FIG. 5 is a flow chart illustrating a flow of the processing of a detection processing program executed by the CPU 80 when a user inputs an instruction for starting execution through the operation display unit 90. In addition, the detection processing program is installed in the ROM 82 in advance. In the present embodiment, a timing at which the instruction for starting execution is input is used as the timing for executing the detection processing program, but the invention is not limited thereto. For example, another timing such as a timing at which an image having a predetermined number of pages is formed may be used as the timing for executing the detection processing program.

In step 300 of FIG. 5, the CPU 80 specifies a minimum nozzle number for performing image formation on the basis of the size of the image forming region in the crossing direction of the continuous paper P which is determined in accordance with the size of the continuous paper P, and reads out test image information from the storage unit 86. In the subsequent step 302, the CPU 80 forms the test image T on the continuous paper P by driving portions, such as the recording head 50K and the conveyance motor 22, which are related to the conveyance of the continuous paper P, on the basis of the test image information read out in the process of step 300 mentioned above.

In the subsequent step 304, the CPU 80 causes the image reading unit 70 to perform reading for each line until at least one (tip in the conveyance direction in the present embodiment) of one end and the other end of the reference image K1 in the crossing direction is read by the image reading unit 70. When the CPU 80 detects that a black pixel is present in at least one of one end and the other end of the image read by the image reading unit 70, an affirmative determination is made in step 304, and the flow proceeds to the process of step 306.

In step 306, the CPU 80 substitutes 0 (zero) for a variable cnt for counting a difference in a reading timing between one end and the other end based on the image reading unit 70. In the subsequent step 307, the CPU 80 determines whether or not the black pixel detected in step 304 is present in only one end in the crossing direction. When an affirmative determination is made, the CPU 80 proceeds to the process of step 308. When a negative determination is made, the CPU proceeds to the process of step 312.

In step 308, the CPU 80 causes the image reading unit 70 to perform reading for each line until the remaining end (tip in the conveyance direction in the present embodiment) of the reference image K1 in the crossing direction is read by the image reading unit 70. Then, in step 310, the CPU 80 increments one variable cnt for every reading of one line which is performed by the image reading unit 70. When the CPU 80 detects that a black pixel is present in the above-mentioned remaining end of the image read by the image reading unit 70, an affirmative determination is made in step 308, and the flow proceeds to the process of step 312.

Here, the above-mentioned processes of step 304 to step 310 will be described in detail with reference to FIGS. 6 to 8.

Figure 6:
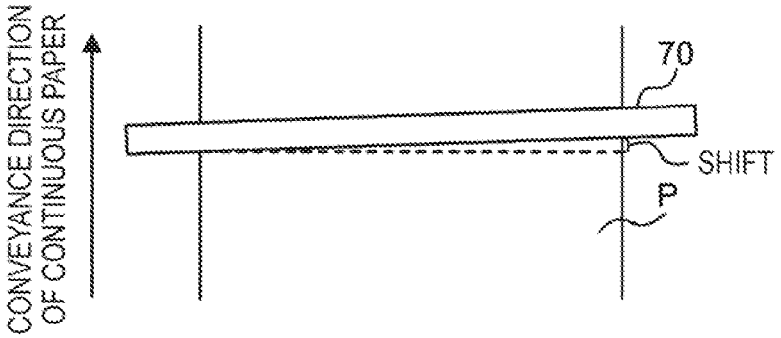
FIG. 6 is a plan view illustrating an example of inclinations of continuous paper and an image reading unit according to the embodiment.

As illustrated in FIG. 6, in the ink jet recording apparatus 10 according to the present embodiment, the test image T may be read by the image reading unit 70 in a state where the image reading unit 70 and the continuous paper P are relatively inclined in the conveyance direction, due to an error of an installation position of the image reading unit 70, the inclination of the continuous paper P which occurs when the continuous paper P is conveyed, or the like.

Figure 7:
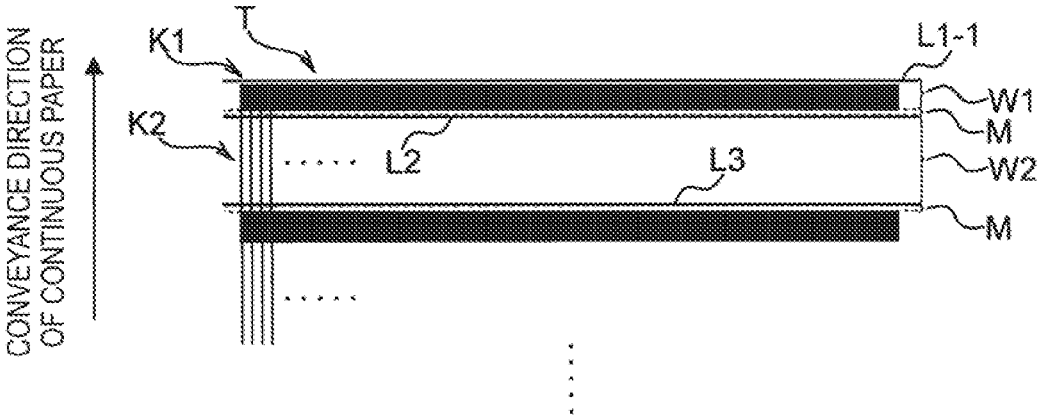
FIG. 7 is a plan view illustrating an example of a reading process performed by the image reading unit in a state where the continuous paper and the image reading unit according to the embodiment are not inclined.

FIG. 7 illustrates an example of a state in a case where the image reading unit 70 and the continuous paper P are not relatively inclined in the conveyance direction.

As illustrated in FIG. 7, the length of the reference image K1 according to the present embodiment in the conveyance direction is set to the length W1. In addition, in the detection image K2 according to the present embodiment, lengths M in the conveyance direction of ends upstream and downstream in the conveyance direction serve as margins, and a portion having a length W2 in the conveyance direction between the margins serves as a detection region which is used to detect an abnormal nozzle.

Hereinafter, a description will be given of an example of a case in which the length W1 is 2.1 mm, the length M is 0.3 mm, the length W2 is 6.4 mm, and the length of a reading line based on the image reading unit 70 in the conveyance direction is 0.1 mm. As illustrated in FIG. 7, when the image reading unit 70 and the continuous paper P are not relatively inclined in the conveyance direction, the CPU 80 detects that a black pixel is present in both ends of a read image in the crossing direction at a timing when the reference image K1 is first read by the image reading unit 70. Meanwhile, in FIG. 7, the position of the reading line at this timing is shown as line L1-1. Accordingly, in this case, at the timing, an affirmative determination is made in step 304, a negative determination is made in step 307, and the value of a variable cnt is set to 0 (zero).

After an image corresponding to the length W1 and the length M is read by the image reading unit 70, the CPU 80 detects an abnormal nozzle. Specifically, the CPU 80 causes the image reading unit 70 to read both ends of the reference image K1 in the crossing direction, and conveys the continuous paper P corresponding to the rest of the length W1 and the length M (corresponding to 2.3 mm in the above-mentioned example), and then causes the image reading unit 70 to start reading the detection image K2. Meanwhile, while the continuous paper P is conveyed by the rest of the length W1 and the length M, reading may be or may not be performed by the image reading unit 70. In addition, in FIG. 7, the position of the reading line at a timing when the reading of the detection image K2 is started is shown as line L2.

On the other hand, FIG. 8 illustrates an example of a state in a case where the image reading unit 70 and the continuous paper P are relatively inclined in the conveyance direction. Meanwhile, here, a description will be given of an example of a case where the image reading unit 70 and the continuous paper P are relatively inclined by the amount that the position of one end of a reference image K1 of a reading line and the corresponding position of the other end are shifted by 2 mm in the conveyance direction.

In this case, as illustrated in FIG. 8, the left end of the reference image K1 in FIG. 8 is read by the image reading unit 70, and then the right end of the reference image K1 in FIG. 8 is read by the nineteenth reading performed by the image reading unit 70. Accordingly, the value of a variable cnt at a timing when an affirmative determination is made in step 308 is set to 19, and the value indicates a difference in a reading timing between the left end and the right end based on the image reading unit 70. Meanwhile, in FIG. 8, the position of a reading line at a timing when the left end is read is shown as line L1-1, and the position of the reading line at a timing when the right end is read is shown as line L1-2.

The CPU 80 causes the image reading unit 70 to read the right end of the reference image K1, and conveys the continuous paper P corresponding to the rest of the length W1 and the length M (corresponding to 2.3 mm in the above-mentioned example), and then causes the image reading unit to start to read the detection image K2. Meanwhile, in FIG. 8, the position of the reading line at a timing when the reading of the detection image K2 is started is shown as line L2.

In step 312 of FIG. 5, the CPU 80 conveys the continuous paper P corresponding to the rest of the length W1 and the length M until the position of the reading line is set to be the position of line L2 as described above, and then proceeds to the process of step 314.

In step 314, the CPU 80 causes the image reading unit 70 to read the detection image K2 one line at a time to thereby acquire luminance information which is output from the image reading unit 70. Then, the CPU 80 performs secondary interpolation on a luminance value indicated by the acquired luminance information to thereby acquire a luminance value for each of the positions of the nozzles to be detected.

Figure 9:
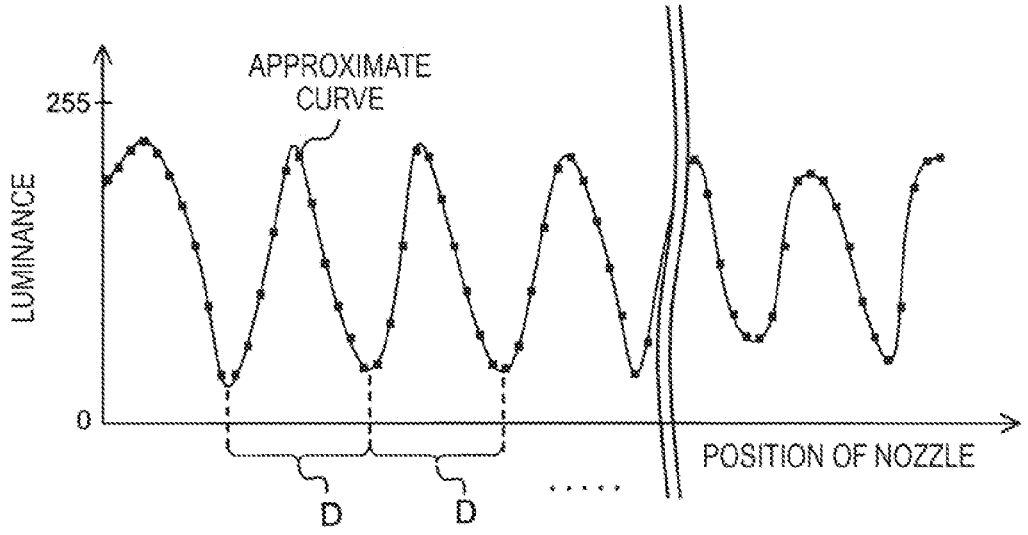
FIG. 9 is a graph illustrating an example of a luminance value for each position of a nozzle according to the embodiment.

The process of step 314 will be described below with reference to FIG. 9. A vertical axis in FIG. 9 represents a luminance value indicated by the luminance information which is output from the image reading unit 70. In addition, in the present embodiment, for example, the luminance value has a discrete value by ones from 0 to 255 (8-bit configuration), and it is assumed that the value becomes closer to white as the value increases and that the value becomes closer to black as the value decreases. In addition, a horizontal axis in FIG. 9 represents the position of each of the nozzles 52 to be detected in the crossing direction, and plotted rectangular points indicate luminance values of pixels which are output from the image reading unit 70.

In step 314 mentioned above, the CPU 80 performs secondary interpolation on the luminance values of the respective pixels which are indicated by the luminance information which is output from the image reading unit 70 to thereby obtain an approximate curve illustrated in FIG. 9 and to derive luminance values corresponding to the positions of the respective nozzles 52.

In the subsequent step 316, the CPU 80 adds the luminance value added in the previous process of step 316 in the repetitive processes of step 314 to step 318 and the luminance value derived in the previous process of step 314 together. Meanwhile, when the process of step 316 is first performed in the repetitive processes of step 314 to step 318, the CPU 80 adds 0 (zero) and the luminance value derived in the previous process of step 314 together.

In step 318, the CPU 80 determines whether or not a termination timing of the reading of the detection image K2 has come. When a negative determination is made, the CPU 80 returns to the process of step 314. On the other hand, when an affirmative determination is made, the CPU proceeds to the process of step 320. Meanwhile, in the present embodiment, as the timing, a timing when the reading performed by the image reading unit 70 is completed X times obtained by the following Expression (1) using the number of times of reading C and a variable cnt, based on the image reading unit 70, which are necessary for the reading of the line corresponding to the length W2 is used.

$$x=C-cnt \tag{1}$$

Accordingly, in a case illustrated in FIG. 7, reading is performed 64 times (=6.4/0.1) by the image reading unit 70 from the position of line L2 to the position of line L3. In a case illustrated in FIG. 8, reading is performed 45 times (=64−19) by the image reading unit 70 from the position of line L2 to the position of line L3.

In step 320, the CPU 80 averages the luminance value, added by repeatedly performing the processes of step 314 to step 318, by dividing the luminance value by the number of times of reading X of the detection image K2 which is performed by the image reading unit 70.

In the subsequent step 322, the CPU 80 sets a threshold value Y to be used in step 324 to be described below so that the rate at which it is determined to be an abnormal state is lowered as a difference between a timing when one end of the reference image K1 in the crossing direction is read by the image reading unit 70 and a timing when the other end thereof is read increases. Specifically, the CPU 80 sets a larger threshold value V as the value of the variable cnt increases.

In the subsequent step 324, the CPU 80 converts an interval (interval D illustrated in FIG. 9) between peak values projecting downward in the luminance value averaged in the process of step 320 into an interval for each of adjacent straight lines of the detection image K2 on the basis of the resolution of the image reading unit 70. Then, the CPU 80 derives a difference between the converted interval and an actual interval between the corresponding nozzles 52, and determines the nozzle 52 located at the corresponding position to be an abnormal nozzle when the difference is equal to or greater than the threshold value Y set in the process of step 322. Further, the CPU 80 specifies a nozzle number corresponding to the abnormal nozzle on the basis of the position of the nozzle 52 determined to be an abnormal nozzle and the nozzle number acquired in the process of step 300, and stores the nozzle number in the storage unit 86.

Meanwhile, in step 324, the CPU 80 may perform a process of determining an abnormal nozzle on a peak value having a luminance value being equal to or greater than a predetermined threshold value among peak values projecting downward, without regarding the peak value as a peak value. As the threshold value in this case, a threshold value set by a user through the operation display unit 90 or, for example, a mean value between a maximum value and a minimum value of the luminance value averaged in the process of step 320 may be used.

In the subsequent step 326, the CPU 80 determines whether or not the processes of step 304 to step 324 have been completed with respect to all of the reference images K1 and the detection images K2. When a negative determination is made, the CPU 80 returns to the process of step 304. On the other hand, when an affirmative determination is made, the CPU proceeds to the process of step 328.

In step 328, the CPU 80 determines whether or not an abnormal nozzle has been detected by determining whether or not a nozzle number of an abnormal nozzle is stored in the storage unit 86. When an affirmative determination is made, the CPU 80 proceeds to the process of step 330.

In step 330, the CPU 80 reads out a nozzle number of an abnormal nozzle from the storage unit 86 and reports the nozzle number by displaying the nozzle number on the operation display unit 90. Meanwhile, in step 330, the CPU 80 may perform, for example, maintenance processing such as cleaning on the nozzle number. In step 330, for example, the CPU 80 may set a parameter of the nozzle 52 so that the size of each of ink drops ejected from the nozzle 52 adjacent to the nozzle having the nozzle number is larger than that in an ordinary case.

On the other hand, when a negative determination is made in step 328, the CPU terminates the detection processing program without performing the process of step 330.

As described above, the ink jet recording apparatus 10 according to the present embodiment performs reading of the detection image K2 a large number of times by the image reading unit 70 as inclinations of the image reading unit 70 and the continuous paper P which are relative to the conveyance direction are small. Thereby, an abnormal nozzle is detected with a high level of accuracy, as compared with a case where the image reading unit 70 reads the detection image K2 by the number of times (for example, 45 times in the present embodiment) which is set as a fixed value based on the inclinations. In addition, since the image reading unit 70 reads the detection image K2 plural times, influence due to abnormality such as non-ejection abnormality of a sudden and single ink drop from the nozzle 52 is suppressed.

While the exemplary embodiment(s) has been described, the technical scope of the invention is not limited to the description of the embodiment. Various changes and improvements can be made to the embodiment without departing from the spirit of the invention, and the changed and improved embodiments are also included in the technical scope of the invention.

In addition, the embodiment described above does not limit the invention according to claims, and all combinations of the features that are described in the embodiment are not essential in implementing the invention. The inventions of various steps are included in the embodiment described above, and various inventions may be extracted by combining the plural components disclosed in the embodiment. Even when some components are removed from all of the components described in the embodiment, the configuration in which the some components are removed may be extracted as the invention as long as effects are obtained.

Figure 10:
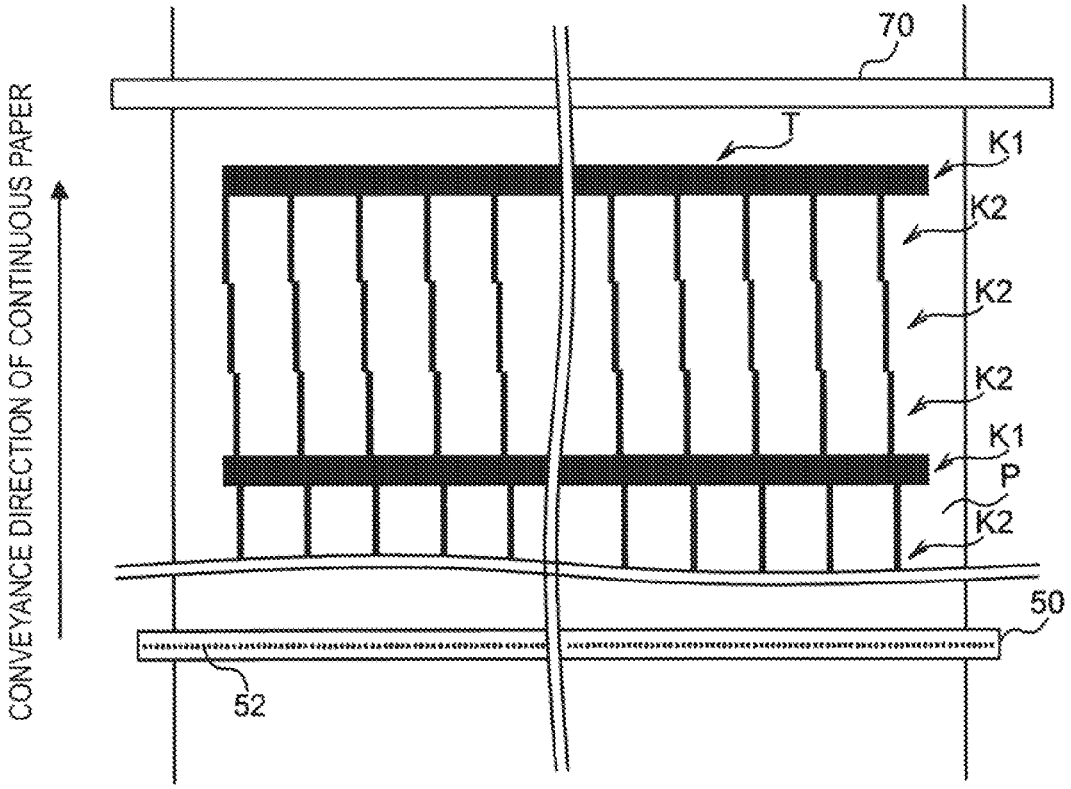
FIG. 10 is a plan view illustrating modified examples of the reference image and the detection image.

For example, in the embodiment, a case where the reference images K1 and the detection images K2 are formed alternately has been described, but the invention is not limited thereto. For example, a configuration may also be adopted in which only one reference image K1 is formed on the upstream side of the detection images K2 in the conveyance direction. In addition, for example, as illustrated in FIG. 10, a configuration may also be adopted in which the reference image K1 and the plural (three in the example illustrated in FIG. 10) detection images K2 are formed alternately.

Figure 11:
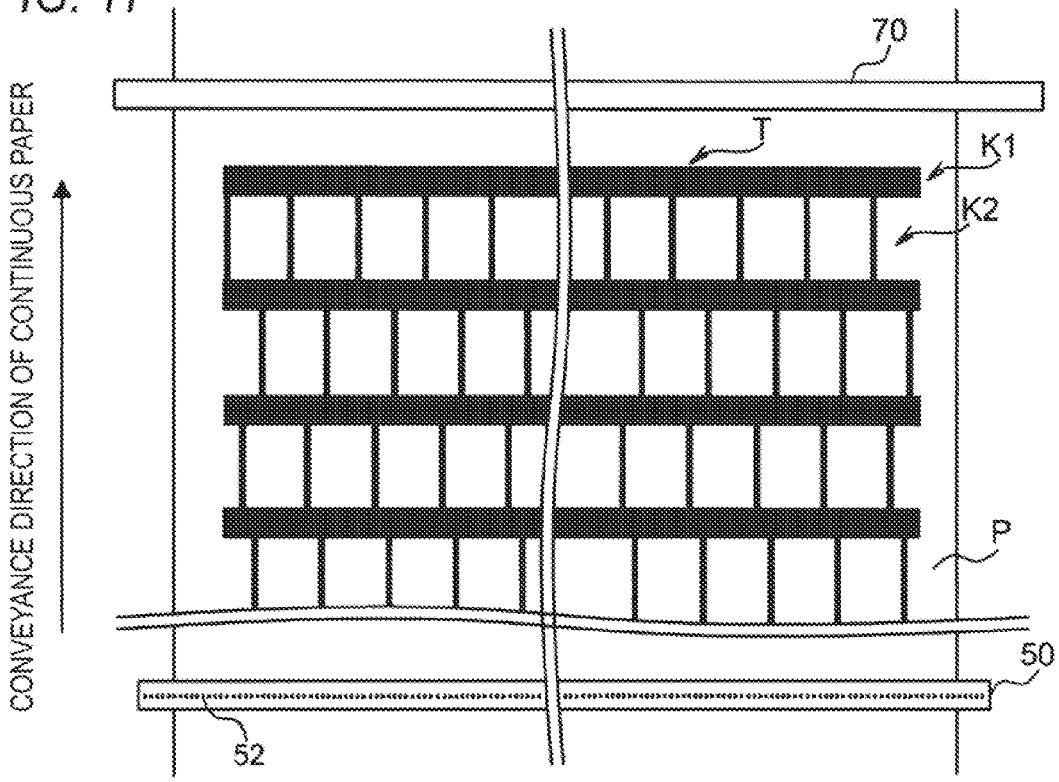
FIG. 11 is a plan view illustrating modified examples of the reference image and the detection image.

In addition, in the embodiment, a case where the detection images K2 are formed stepwise has been described, but the invention is not limited thereto. For example, as illustrated in FIG. 11, a configuration in which the detection images K2 are formed in a zigzag lattice shape may also be adopted.

Figure 12:
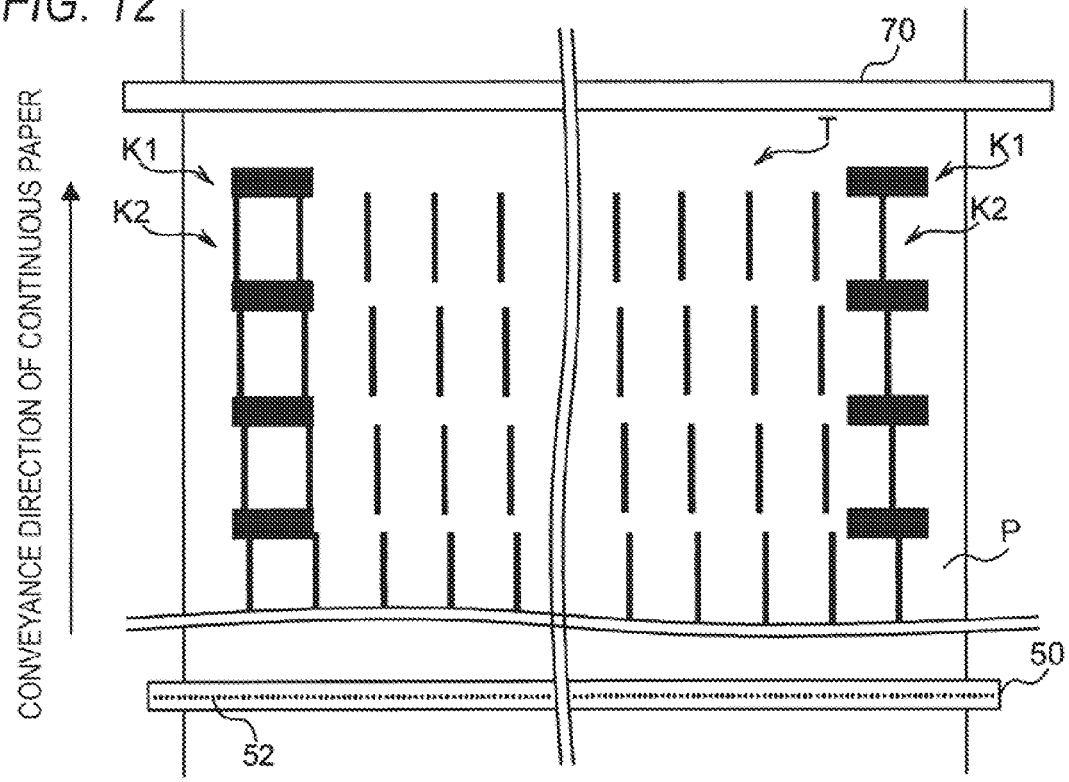
FIG. 12 is a plan view illustrating modified examples of the reference image and the detection image.

In addition, in the embodiment, a description has been given of a case where the reference image K1 is formed by all of the nozzles to be detected, but the invention is not limited thereto. For example, as illustrated in FIG. 12, a configuration may also be adopted in which the reference image K1 is formed by only the plural nozzles 52 which are arrayed to be continuous with both ends thereof in the crossing direction among the nozzles to be detected.

In addition, in the embodiment, a description has been given of a case where an abnormal nozzle is detected by setting a larger threshold value Y as a difference between a timing when one end of the reference image K1 in the crossing direction is read by the image reading unit 70 and a timing when the other end thereof is read increases, but the invention is not limited thereto. For example, a configuration may also be adopted in which an abnormal nozzle is detected by reducing the interval D based on the detection image K2 read by the image reading unit 70 as the difference in the timing increases without changing the threshold value Y. In addition, for example, a configuration may also be adopted in which both the threshold value Y and the interval D are adjusted in accordance with the difference in the timing.

In addition, in the embodiment, a description has been given of a case where a length for reading both ends of the reference image K1 in the crossing direction by single reading operation of the image reading unit 70 in a state where the image reading unit 70 and the continuous paper P are relatively inclined in the conveyance direction is used as the length W1, but the invention is not limited thereto. For example, a configuration may also be adopted in which both ends of the reference image K1 in the crossing direction are not read by one reading operation of the image reading unit 70 in a state where the image reading unit 70 and the continuous paper P are relatively inclined in the conveyance direction. In this case, for example, one end of the reference image K1 in the crossing direction is first read by the image reading unit 70. Thereafter, black pixels being continuous in the crossing direction of the image read by the image reading unit 70 are detected, and thus it is detected that the image is the reference image K1. Further, thereafter, the other end of the reference image K1 in the crossing direction is read by the image reading unit 70. In addition, a configuration is illustrated in which an abnormal nozzle is detected by setting the number of times of reading of the detection image K2 which is performed by the image reading unit 70 and the threshold value Y used to detect an abnormal nozzle in a similar manner to the embodiment described above on the basis of a difference in a reading timing between the one end and the other end.

Although this is not particularly mentioned in the embodiment, a configuration may also be adopted in which the presence or absence of an abnormal nozzle is determined before a nozzle number of an abnormal nozzle is specified. In this case, for example, a configuration is illustrated in which a process of determining the presence or absence of an abnormal nozzle is performed between step 320 and step 322 of the detection processing program. In addition, as the determination process of this configuration example, a configuration is illustrated in which an abnormal nozzle is determined to be present when the number of peak values projecting downward mentioned above is different from the number of nozzles 52 used to form the corresponding detection image K2. With regard to non-ejection abnormality, the presence or absence of an abnormal nozzle is determined by the determination process.

Although this is not particularly mentioned in the embodiment, a configuration may also be adopted in which the installation position (inclination angle with respect to the conveyance direction) of the image reading unit 70 is corrected on the basis of a difference in a reading timing between one end and the other end of the reference image K1 in the crossing direction.

In addition, in the embodiment, a description has been given of a case where one long head is used as the recording head 50, but the invention is not limited thereto. For example, a configuration may also be adopted in which plural short heads arrayed along the crossing direction are used as the recording head 50.

In addition, in the embodiment, a description has been given of a case where the invention is applied to an ink jet recording apparatus, but the invention is not limited thereto. For example, a configuration may also be adopted in which the invention is applied to another image forming apparatus such as a light emitting diode (LED) printer.

In addition, in the embodiment, a description has been given of a case where the continuous paper P is used as a recording medium, but the invention is not limited thereto. For example, a configuration may also be adopted in which regular-sized cut paper such as A4 or A3 is used as a recording medium. In addition, the material of the recording medium is not limited to paper, and a configuration may also be adopted in which a recording medium made of another material is used.

In addition, in the embodiment, a description has been given of a case where a detection processing program is installed in the ROM 82 in advance, but the invention is not limited thereto. For example, a configuration in which the detection processing program is stored in a storage medium such as a compact disk read only memory (CD-ROM) and is provided or a configuration in which the detection processing program is provided through a network may also be adopted.

Further, in the embodiment, a description has been given of a case where a detection process is realized by a software configuration using a computer by executing a program, but the invention is not limited thereto. For example, a configuration may also be adopted in which the detection process is realized by a hardware configuration or a combination of a hardware configuration and a software configuration.

Moreover, the configuration (see FIGS. 1 to 3) of the ink jet recording apparatus 10 described in the embodiment is merely an example, and it is needless to say that unnecessary parts may be deleted or new parts may be added without departing from the scope of the invention.

In addition, the flow (see FIG. 5) of processing of the detection processing program described in the embodiment is merely an example, and it is needless to say that unnecessary steps may be deleted, new steps may be added, or the processing order may be changed without departing from the scope of the invention.

What is claimed is:

1. An image forming apparatus comprising:

plural recording elements that are arrayed along a crossing direction crossing a conveyance direction of a recording medium;

a reading unit that sequentially reads an image formed on the recording medium for each line extending in the crossing direction along the conveyance direction by driving the recording elements while conveying the recording medium;

a forming unit that drives the recording elements that are continuously arrayed along the crossing direction while conveying the recording medium, so as to form at least one reference image, having a length in the conveyance direction being set to a length in accordance with plural times of the readings by the reading unit, on the recording medium, and then makes timings for driving the recording elements continuously arrayed in the crossing direction different from each other with respect to the plural recording elements to be subjected to detection of an abnormal state thereof, so as to form detection images on the recording medium; and a detection unit that detects the recording element in the abnormal state by changing a size of at least one of a threshold value and a detected value based on the detection image read by the reading unit so that a rate at which it is determined to be the abnormal state is lowered as a difference between a timing when one end of the at least one reference image in the crossing direction is read by the reading unit and a timing when the other end thereof is read increases, when the recording element in the abnormal state is detected using the detected value and the threshold value.

2. The image forming apparatus according to claim 1, wherein the forming unit forms the detection images on the recording medium by dividing the recording elements to be subjected to detection of the abnormal state into plural recording element groups in each of which ones of the plural recording elements are arrayed in the crossing direction at intervals corresponding to a predetermined number of recording elements and by making a driving timing different for each of the recording element groups.

3. The image forming apparatus according to claim 2, wherein the at least one reference image comprises the reference images, and the forming unit alternately forms the reference images and the detection mages on the recording medium in the conveyance direction.

4. The image forming apparatus according to claim 2, wherein a length of each of the detection images in the conveyance direction which are formed by driving the plural recording element groups at different timings is set to a length in accordance with plural times of the readings by the reading unit, and the detection unit causes the reading unit to read each of the detection images by increasing a number of times of the readings as a difference between a timing when one end of the least one reference image in the crossing direction is read by the reading unit and a timing when the other end thereof is read decreases, so as to detect the recording element in the abnormal state.

5. The image forming apparatus according to claim 1, wherein the forming unit forms the at least one reference, image by driving the plural recording elements which are continuously arrayed at positions including both ends of an image forming region of the recording medium in the crossing direction.

6. The image forming apparatus according to claim 5, wherein the forming unit forms the at least one reference image without driving the recording elements which are arrayed in an intermediate portion between both ends.

7. The image forming apparatus according to claim 1, wherein a length of the at least one reference image in the conveyance direction is set to a length for reading one end and the other end of the reference image by single reading operation of the reading unit in a state where the reading unit and the recording medium are relatively inclined in the conveyance direction by a predetermined allowable maximum angle.

8. An image forming method of an image forming apparatus which comprises plural recording elements that are arrayed along a crossing direction crossing a conveyance direction of a recording medium; and a reading unit that sequentially reads an image formed on the recording medium for each line extending in the crossing direction along the conveyance direction by driving the recording elements while conveying the recording medium, the method comprising:

driving the recording elements that are continuously arrayed along the crossing direction while conveying the recording medium, so as to form at least one reference image, having a length in the conveyance direction being set to a length in accordance with plural times of the readings by the reading unit, on the recording medium, and then making timings for driving the recording elements continuously arrayed in the crossing direction different from each other with respect to the plural recording elements to be subjected to detection of an abnormal state thereof, so as to form detection images on the recording medium; and detecting the recording element in the abnormal state by changing a size of at least one of a threshold value and a detected value based on the detection image read by the reading unit so that a rate at which it is determined to be the abnormal state is lowered as a difference between a timing when one end of the at least one reference image in the crossing direction is read by the reading unit and a timing when the other end thereof is read increases, when the recording element in the abnormal state is detected using the detected value and the threshold value.

9. A non-transitory computer readable medium storing a program for causing a computer to function as the forming unit and the detection unit of the image forming apparatus according to claim 1.

* * * * *